United States Patent [19]

Todokoro

[11] 4,182,071

[45] Jan. 8, 1980

[54] TOY TELEVISION SET

[76] Inventor: Masatoshi Todokoro, 2-33 Kognaehara 2-chome, Matsudo-City, Chiba-Prefecture, Japan, 270

[21] Appl. No.: 857,932

[22] Filed: Dec. 6, 1977

[51] Int. Cl.[2] ..... A63H 33/30

[52] U.S. Cl. ..... 46/1 R; 40/475; 46/14

[58] Field of Search ..... 40/475, 533, 536; 46/1 R, 14, 15, 35–37; 58/127 R, 126 E

[56] References Cited

U.S. PATENT DOCUMENTS

| | | | |
|---|---|---|---|
| 715,776 | 12/1902 | Fitch | 58/126 E |
| 3,388,499 | 6/1968 | Mercorelli | 46/14 |

*Primary Examiner*—Louis G. Mancene
*Assistant Examiner*—Robert F. Cutting

[57] ABSTRACT

A toy television set whereby the pictures, characters, words, etc., drawn on a plurality of leaves can be seen in succession through a transparent screen as the leaves are turned over successively. The device comprises a case modeled after the cabinet of a real TV set, a transparent screen provided on the front side of the case, a horizontal shaft provided across the center of the screen in the inside of the case, a prime mover adapted to give the rotative power to said shaft, a pair of discs provided at both ends of said horizontal shaft, each of said discs having formed therein a plurality of holes along the periphery thereof, and a plurality of leaves on which pictures, words, etc., are drawn, each of said leaves having extending from both sides of its lower end the insert pieces fitting in the corresponding holes in said discs.

1 Claim, 7 Drawing Figures

TOY TELEVISION SET

This invention relates to a toy television set whereby the pictures, words, characters, etc., drawn on a plurality of leaves can be seen in succession through a transparent screen as the leaves are turned over successively.

The device of this invention is described in detail hereinbelow by way of an embodiment thereof with reference to the accompanying drawings, in which.

Figure 4:
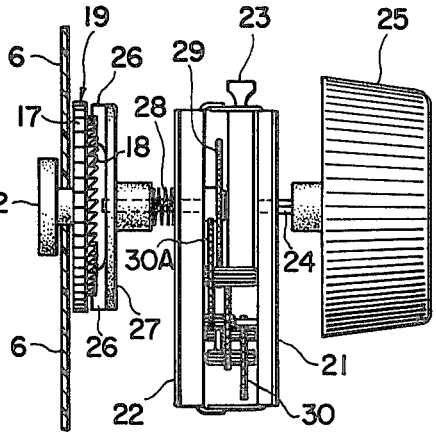
FIG. 4 is an enlarged top plan view of the prime mover used in the device of this invention.
Figure 5:
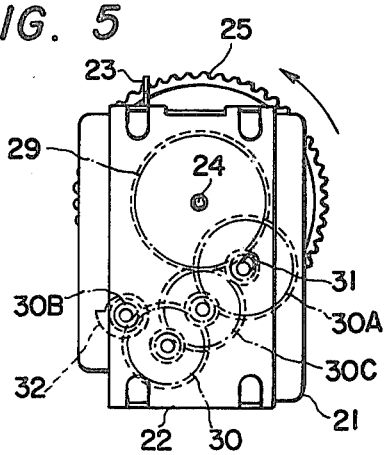
FIG. 5 is a side view thereof.

Referring generally to the drawings, numeral 1 designates a case modeled after the cabinet of a portable TV set. Said case 1 is mounted on its front side with a screen 2 made of a transparent plate having a lens effect and is open on its back side. The open side of the case 1 is covered by a back plate 3 which bulges out at its middle part to form a half-circular bulge 4 which is provided with a plurality of holes 5 imitating the vent holes in the TV set. Provided integrally on the interior of said back plate 3 are a pair of support plates 6 and 7 extending parallel to each other sidewise as viewed from the screen side of the case 1 and a bottom plate 8 mounted horizontally between the lower ends of said both support plates 6 and 7. A shaft or bar 9 is provided extending transversely across the central part of the screen 2, with both ends of said shaft 9 being supported in the middle parts of said support plates 6 and 7. Secured to the parts of the shaft 9 positioned inside and close to the respective support plates 6 and 7 are the discs 11 and 12 each of which is formed with a plurality of holes 10 along the circumferential periphery thereof. Numeral 13 indicates a plurality of leaves each of which has a size corresponding to the half of the exposed area of the screen 2 so that the drawings on every two corresponding leaves present a complete picture, etc., when such two leaves appear through the screen 2. That is, a picture, a word (or a paragraph of words), etc., is drawn in two portions, one on the rear side of a leaf and the other on the front side of the succeeding leaf, so that a series of pictures of, for example, vehicles or a story in pictures may be shown through the screen by turning over the leaves successively. Extending from both sides of the lower end of each of said leaves are insert elements 14 and 15 adapted to fit in the corresponding holes 10 in the discs 11 and 12 are supported around the shaft 9. 16 is a leaf engaging member of which one end is secured to an upper central part on the inside of the back plate 3 and the other end is arranged to engage with the upper end of each leaf 13 which turned up to its vertical position with rotation of the shaft 9. A disc clutch 17 is secured to the end of the shaft 9 which projects outside of one of the support plates 6, said disc clutch 17 being provided on its external side with a ratchet 18 designed to describe a circule about the shaft 9. It is also provided peripherally thereof with a ratchet 19 of the same direction as said ratchet 18. Numeral 20 refers to a detent bar of which one end is secured to an upper inside part of the back plate 3 and the other end is engaged with the ratchet 19, and numeral 21 indicates a prime mover for giving the rotative power to the shaft 9. This prime mover 21, as shown in FIGS. 4 and 5, has an angular driving shaft 24 loaded with a windup spring 23 and supported by a frame 22, with one end of said driving shaft 24 being secured to a grip 25 and the other end being slidably fitted in the central part of a circular driving plate 27 having pawls 26 engaged with the ratchet 18 on the disc clutch 17, and a spring 28 is compressedly disposed between said driving plate 27 and frame 22 to press the pawls 26 of said driving plate 27 against the ratchet 18 on the clutch 17. Secured to the portion of said driving shaft 24 extending inside of the frame 22 is a driving gear 29 meshed with a train of reduction gears 30 journalled in the frame 22. The first gear 30A of said reduction gear train is pivotally supported in an elongated slot 31 formed in the frame 22 and the final gear 30B has secured thereto a stopper 32. The prime mover unit 21 is secured to the back plate 3 by wood screws 36 in the inside of the side wall 33 of the case 1 opposed to the support plate 6, with one end of the frame 22 being supported by the protuberances 34, 35 extending from the inside of the back plate 3, and the portion of the driving shaft 24 extending between the grip 25 and frame 22 is passed through an opening 37 formed in the side wall 33 from its open end side so that the grip 25 is positioned outside of the case 1. The driving plate 27 is pressed against the clutch plate 17 by a spring 28.

Denoted by numerals 38 and 39 are the grips provided protuberantly at a front side part of the case 1 close to its right-hand end. The upper grip 38 is merely an ornament, but the lower grip 39 is joined to an operating bar 40 which, when said grip 39 is turned to "OFF," is engaged with the stopper 32 of the reduction gear train 30 to stop the operation of the prime mover 21. 41 is a protuberance provided at the central part of the bottom plate 8 for receiving the leaf 13 which has turned to the position underneath the shaft 9. 42 indicates the protuberances extending inwardly from the inside corners of the front portion of the case 1, each of said protuberances 42 having at its end portion an internal threaded hole and arranged such that corresponding one of the similar hollow protuberances 43 extending inwardly from the inside corners of the back plate 3 is butted against said protuberance 42 and a screw 44 inserted into the hollow portion of each said protuberance 43 is driven into the internal threaded hole of the corresponding protuberance 42, thereby securely joining the case 1 to the back plate 3.

Now the operation of the toy television according to this invention having the above-described construction is explained. When the grip 25 is turned in the direction of arrow in FIG. 5, the windup spring 23 is wound up to accumulate the rotative power and the driving gear 29 and driving plate 27 are rotated. However, as the first gear 30A of the reduction gear train 30 is moved along the elongated slot 31 to a position where it disengages from the succeeding gear 30C by the rotation of the driving gear 29, the rotation of the driving gear 29 is not transmitted to the reduction gear train 30. Also, since the pawls 26 of the driving plate 27 slide idly over the ratchet 18 of the clutch plate 17 and the stopper bar 20 stays engaged with the ratchet 19 of the clutch plate 17 to lock the clutch plate 17, the rotation of the driving plate 27 is not transmitted to the shaft 9.

Figure 1:
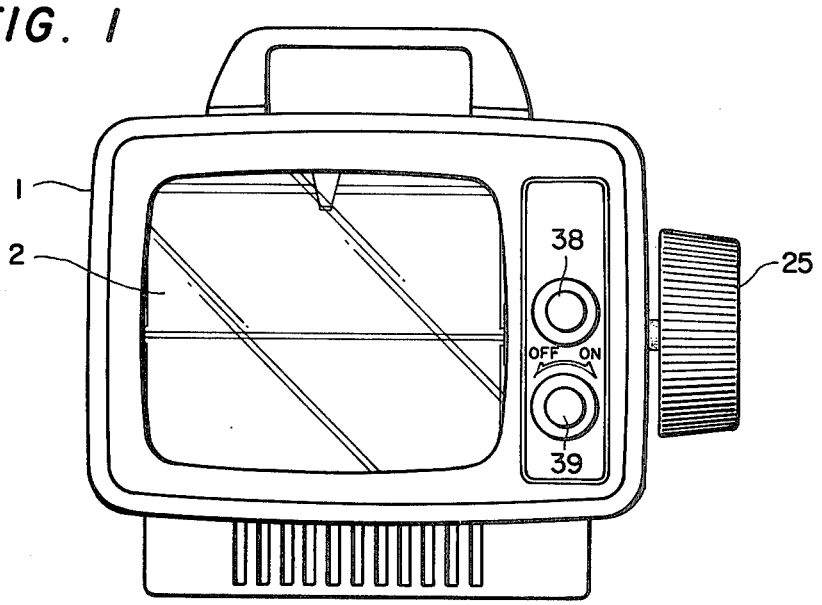
FIG. 1 is a front view of a toy television set according to this invention.
Figure 2:
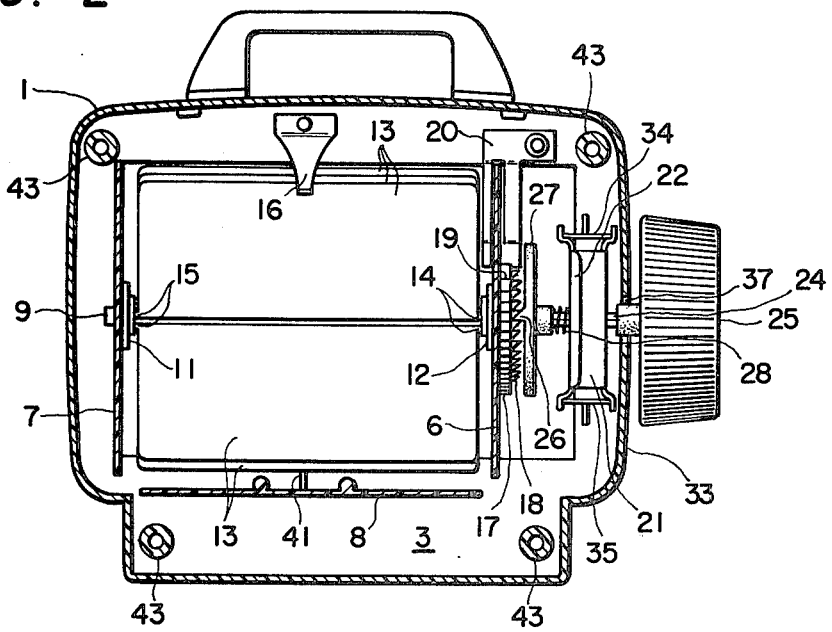
FIG. 2 is also a front view of the device, with parts cut away.
Figure 3:
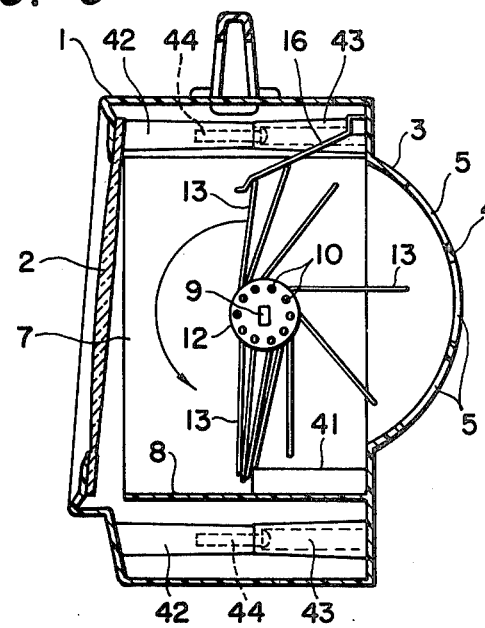
FIG. 3 is a side elevational view of the device, with parts cut away.
Figure 6:
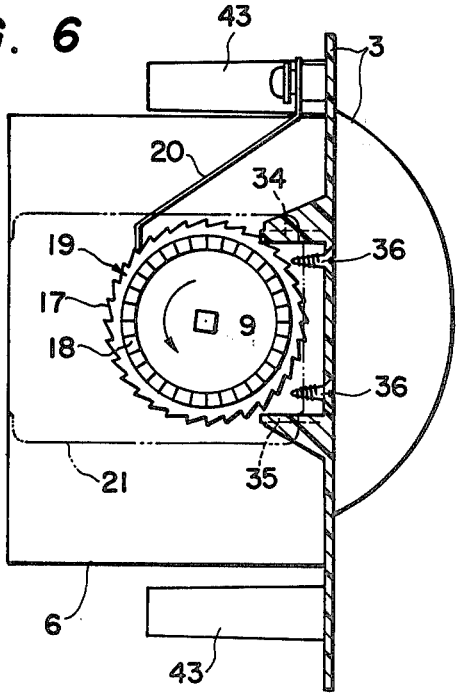
FIG. 6 is an enlarged side elevational view showing the mounted situation of the clutch plate.
Figure 7:
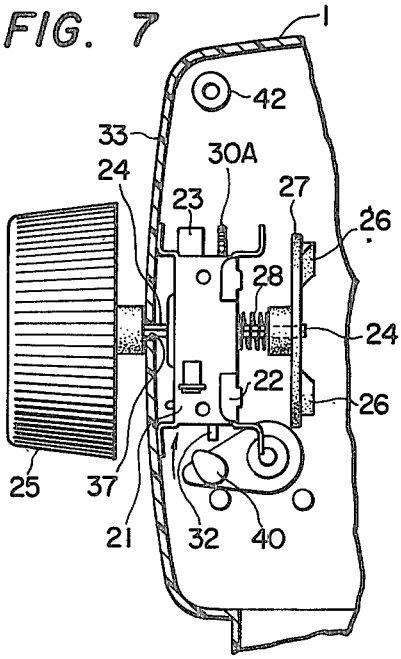
FIG. 7 is a rear view showing the prime mover as adapted in position in the case.

Then, when the hold on the grip 25 is released with the sufficient rotative power having been accumulated on the windup spring 23, such rotative power is transmitted through the driving gear 29 to the gear 30A to let it move along the elongated slot 31 to the position where it is engaged with the gear 30C, so that the rotative power is transmitted, while reduced by the reduction gear train 30, to the driving shaft 24 to let it rotate oppositely to the said direction of turn of the grip 25, whereby the driving plate 27 is also turned in the same direction to let the pawls 26 engage with the ratchet 18 of the clutch plate 17 while the stopper bar 20 slides over the ratchet 19 to let the clutch 17 turn in the direction of arrow in FIG. 6, so that the rotative power is now transmitted to the shaft 9 to let it rotate, causing the leaves 13 to turn accordingly in the direction of arrow in FIG. 3. Thus, the respective leaves 13 rise up to the position of the engaging member 16, come off it and are thereby turned over successively, whereby a plurality of pictures, characters, words, etc., appear magnified on the screen 2 in succession.

If the grip 39 is turned to OFF during rotation of the leaves 13, the operating bar 40 is engaged with the detent piece 32 in the prime mover unit 21 to stop the operation of the prime mover 21, so that a certain picture, a word or a group of words, etc., is presented stationary on the screen 2. If the grip 39 is turned to ON under this condition, the prime mover 21 resumes its operation to continue rotation of the leaves 13 until the rotative power is used up.

In the above-described embodiment, a transparent plate having a lens effect is used for the screen, but it is possible to use a transparent plate having no such lens effect. Also, a motor may be employed as prime mover instead of clockwork used in the shown embodiment.

Thus, according to the device of this invention having the above-described construction, when the prime mover is operated by clockwork or other means, the leaves are turned over successively and a plurality of pictures, words, etc., appear in succession through the screen on the front side of the case, just like a real TV set, giving a lot of amusement to the viewers.

What is claimed is:

1. A toy television set comprising a case modeled after the cabinet of a real TV set, a transparent screen provided on the front side of said case, a horizontal shaft disposed across the center of said screen in the inside of said case, a clutch plate secured to an end of the shaft, a prime mover with an output end adapted to give rotative power to said shaft including, a driving plate having pawls and a windup spring, said pawls being engagable with said clutch plate, and being secured at the prime mover output end loaded with said windup spring which is wound up by a grip extending outside of the case, a driving gear and a reduction gear train, said driving gear being secured to said driving shaft in engaged relation with said reduction gear train, said gear train including a slot support and a first gear pivotally supported in said slot support along which it is movable in an elongated manner to a position where it disengages from the succeeding gear, and a final gear of said gear train, with a detent and an operating bar engageable with said detent coupled to said grip mounted rotatably outside said case, a ratchet along the peripheral edge of said clutch plate and a stopper bar engaged with said ratchet to lock the clutch plate when said clutch plate is turned in the direction of windup of the windup spring, a pair of discs, one disc being secured to each end of said shaft, each of said discs being formed with a plurality of holes along the periphery thereof and, a plurality of leaves with sides and lower ends on which pictures, characters, words, etc. are drawn, each of said leaves having extending from both sides of the lower end thereof insert pieces designed to fit into the corresponding holes in said discs.

* * * * *